US005883318A

United States Patent [19]

Deutsch

[11] Patent Number: 5,883,318

[45] Date of Patent: Mar. 16, 1999

[54] DEVICE FOR CHANGING THE TIMBRE OF A STRINGED INSTRUMENT

[76] Inventor: Mark D. Deutsch, 563 Melville, Apt. 1 South, University City, Mo. 63130

[21] Appl. No.: 853,144

[22] Filed: May 8, 1997

[51] Int. Cl.[6] ..... G10D 3/00

[52] U.S. Cl. ..... 84/295; 84/307; 84/309

[58] Field of Search ..... 84/295, 294, 274, 84/307, 309

[56] References Cited

U.S. PATENT DOCUMENTS

| | | | |
|---|---|---|---|
| 104,324 | 6/1870 | Knox | 84/295 |
| 1,110,654 | 9/1914 | Speer | 84/295 |
| 1,214,075 | 1/1917 | Rice | 84/295 |
| 1,489,710 | 4/1924 | Olsen | 84/295 |
| 1,513,159 | 10/1924 | Cremer | 84/295 |
| 1,588,730 | 6/1926 | Hessel | 84/294 |
| 2,473,980 | 6/1949 | Willner | 84/295 |
| 2,741,937 | 4/1956 | Auville et al. | 84/274 |
| 4,122,745 | 10/1978 | Darias Paya | 84/267 |
| 4,282,792 | 8/1981 | Voorthuyzen | 84/295 |

FOREIGN PATENT DOCUMENTS 1684 of 1856 United Kingdom .

*Primary Examiner*—William M. Shoop, Jr.
*Assistant Examiner*—Shih-yung Hsieh
*Attorney, Agent, or Firm*—Grace J. Fishel

[57] ABSTRACT

A device for changing the timbre of a stringed instrument of the violin or viol family. The device includes a plurality of sympathetic strings, rigidly fixed at opposite ends in a frame suspended over a sound board of the instrument. A javari bridge is mounted on the sound board, a distance from a main bridge, with the sympathetic strings passing over the javari bridge. When the sympathetic strings are set into vibration by the main strings, the javari bridge brings out upper harmonic vibrations in the sympathetic strings, changing the timbre of the instrument. The javari bridge also makes the upper harmonic vibrations more audible and shortens the period of vibration, avoiding the dissonance associated with sympathetic strings strung over a conventional bridge. When the javari bridge is stepped, the sympathetic strings may be strung in tiers, allowing more strings to be strung in less space and expanding the harmonic sounds produced by the instrument.

11 Claims, 4 Drawing Sheets

DEVICE FOR CHANGING THE TIMBRE OF A STRINGED INSTRUMENT

BACKGROUND OF THE INVENTION

1. Field of the Invention

The present invention relates to a device for changing the timbre of a stringed instrument that is played with a bow by bringing out the upper harmonics in a set of sympathetic strings, making them more audible and shortening the period of their vibration.

2. Brief Description of the Prior Art

Sympathetic strings have been added to stringed instruments of the violin or viol family, tracing back to European baroque instruments such as the viola d'amore, the viola bastarda and the baryton. When the sympathetic strings on such instruments are tuned to a fundamental frequency or to one of the harmonic overtones of the main strings, they are set into harmonic vibration when the main strings are plucked or bowed. The sympathetic strings do not materially affect the timbre of the instrument as they transmit substantially the same bundle of harmonics that set them into vibration. The sympathetic strings, however, increase the length of the sound, continuing to emit a sustained tone even after plucking or bowing is stopped or fingering is altered. This results in a muddy, dissonant collection of sounds, which insofar as known, none of the prior art instruments provided an effective way to dampen.

In all or most instances, the sympathetic strings on prior art instruments are attached to the sound board (i.e, face). Such attachment may likely affect the resonance of the sound board and alter the tone of the main strings. In those instruments where the sympathetic strings are located on the inside of the sound box, they are difficult to reach for tuning. None of the instruments, insofar as known, have more than twelve sympathetic strings as they lack space for any more. While one sympathetic string will produce a certain amount of effect, a chromatic octave of twelve is the minimum required, and more strings, as disclosed herein, are even better.

SUMMARY OF THE INVENTION

In view of the above, it is an object of the present invention to provide a device for adding a plurality of sympathetic strings to a stringed instrument of the violin or viol family and making them more audible. It is another object to provide a device that changes the timbre of a stringed instrument by bringing out the upper harmonics in a set of sympathetic strings. It is also an object to provide a device that permits the addition of more than twelve sympathetic strings and shortens the period of their vibration. Other objects and features of the invention will be in part apparent and in part pointed out hereinafter.

In accordance with the invention, a device is provided for changing the timbre of a stringed instrument having a bridge, a sound board and a set of main strings that are played with a bow. The device has a plurality of sympathetic strings adapted to be tuned to resonant frequencies in harmonic reference to the main strings. The sympathetic strings are rigidly mounted under the main strings in a frame suspended over the sound board. The sympathetic strings pass over a javari bridge which is provided on the sound board, spaced apart from the main bridge. When the main strings are plucked or bowed, the vibrations on the main strings are transferred to any of the sympathetic strings capable of sympathetic vibration. The javari bridge brings out upper harmonic vibrations in the sympathetic strings, changing the timbre of the instrument. The bridge also makes the vibrations of the sympathetic strings more audible and shortens the period of vibration, thereby avoiding dissonance.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
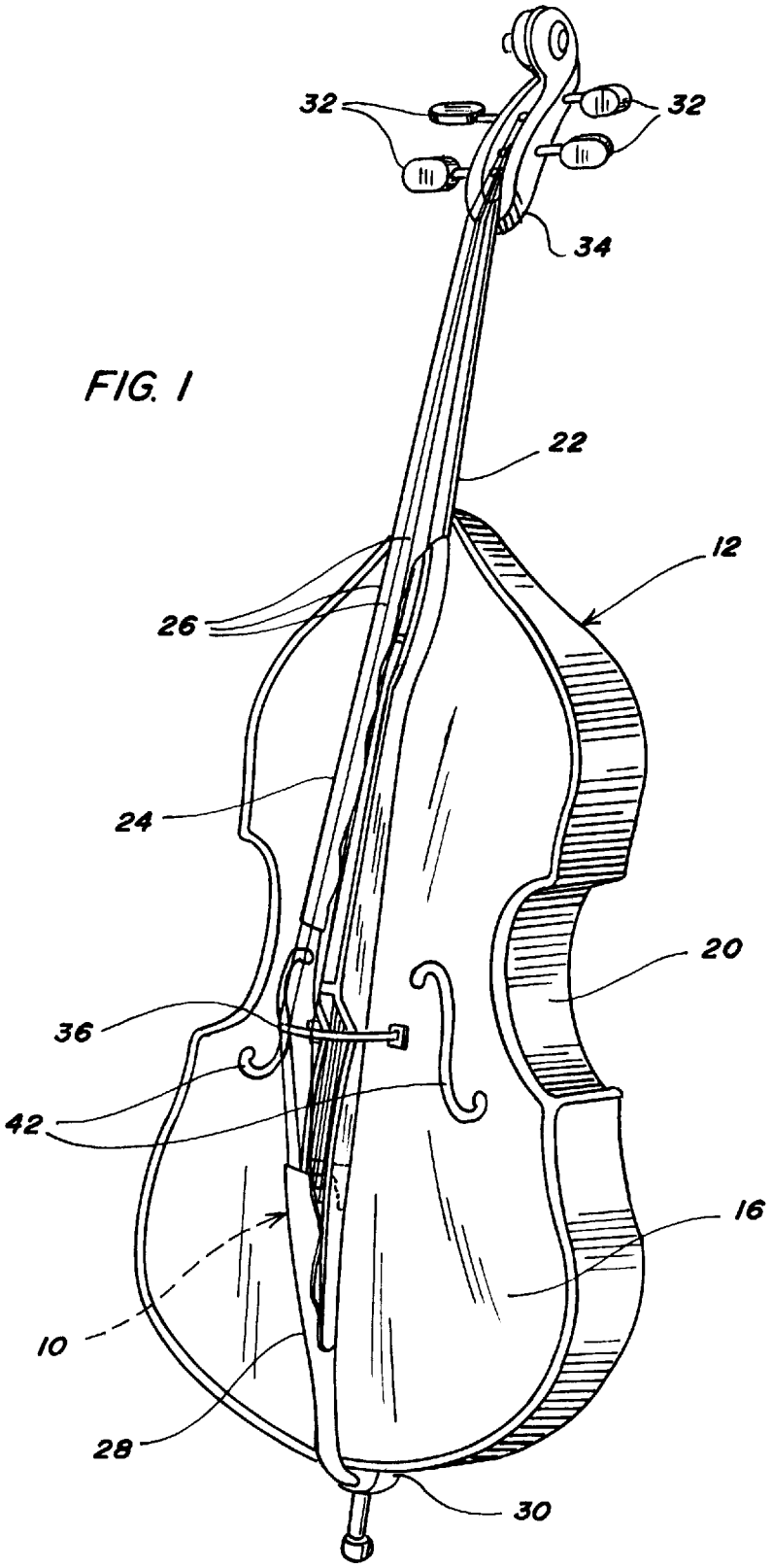
FIG. 1 is a perspective view, partly in cross-section, of a stringed instrument outfitted with a device having a plurality of sympathetic strings for changing the timbre of the stringed instrument in accordance with the present invention.
Figure 2:
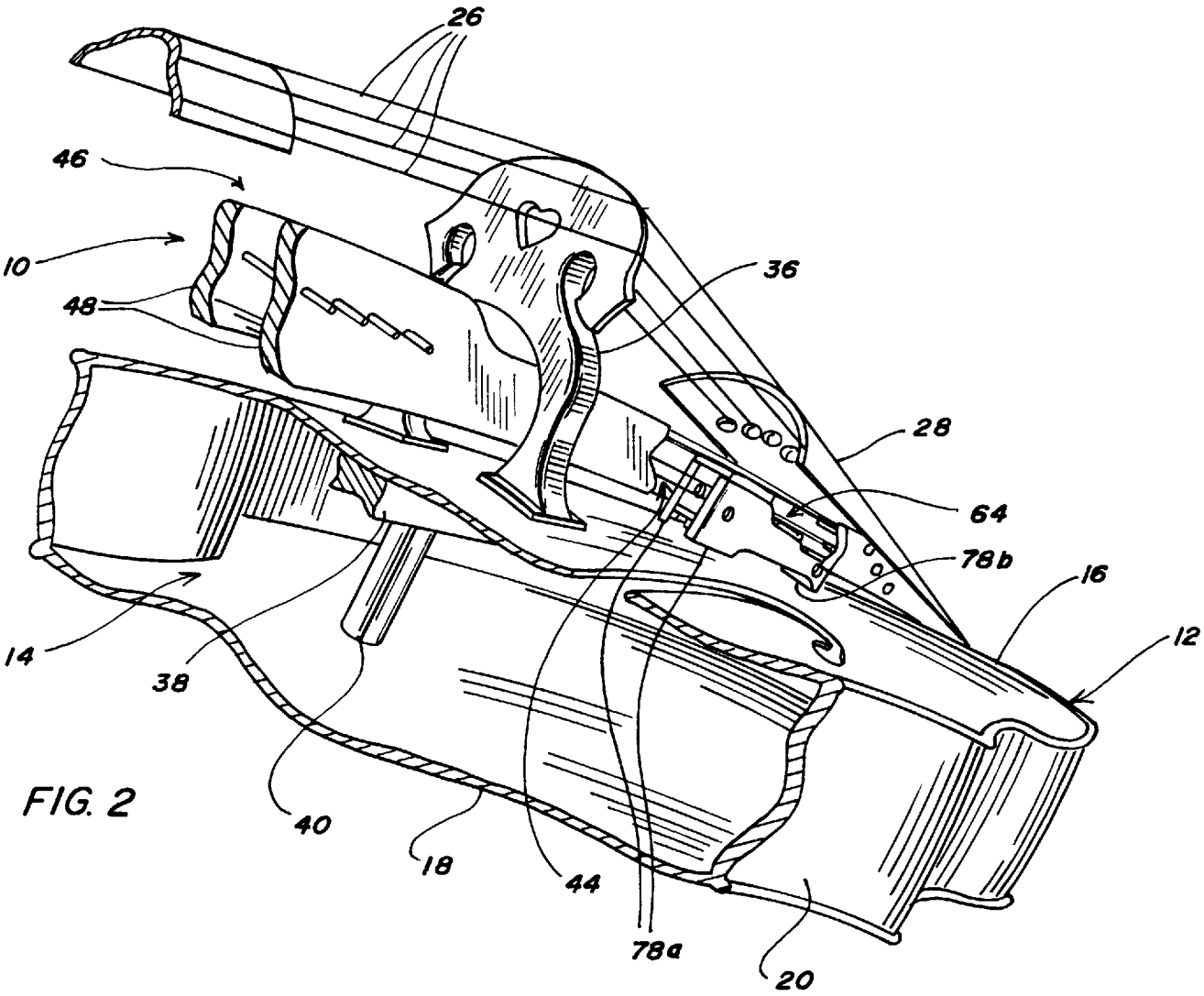
FIG. 2 is a detailed perspective view, partly in cross-section, showing the device with a plurality of sympathetic strings arranged in three tiers passing over a javari bridge having a javari plate for each tier.

Referring to the drawings more particularly by reference character, reference numeral 10 refers to a device for selectively changing the timbre of a stringed instrument 12 that is played with a bow, more particularly, a stringed instrument of the violin or viol family. As shown in FIGS. 1 and 2, stringed instrument 12 is a double bass of conventional design. Stringed instrument or double bass 12 has a body or sound box 14 including a face or sound board 16 and a back wall 18 joined by an encircling rib 20. A neck 22 with a fingerboard 24 is attached to sound box 14. Four or five main strings 26 are secured at one end to a floating tailpiece 28 attached by a cable to an end button 30 opposite neck 22. The other end of the strings are wound about tuning pegs 32 in a pegbox 34 at the scroll.

Between tuning pegs 32 and tailpiece 28, main strings 26 are suspended over fingerboard 24 and sound board 16 between a nut (not shown) and a main bridge 36. The nut is attached to neck 22 and main bridge 36 is seated on sound board 16. One foot of main bridge 36 is over a base bar 38 which is provided as a reinforcement on the underside of sound board 16, offset from the midline, between neck 22 and end button 30. The other foot of main bridge 36 is adjacent a sound post 40 connecting the sound board to the back and increasing the resonance of the instrument. When main strings 26 are plucked or bowed, main bridge 36 is set into vibration, causing sound board 16 to resonate, which vibrations are transferred by base bar 38 and sound post 40 to sound box 14 where they are amplified and then emitted through sound holes 42. Not all vibrations are amplified equally by the instrument and the ones that are amplified determine the timbre, musical quality or tone color of the particular instrument.

Figure 3:
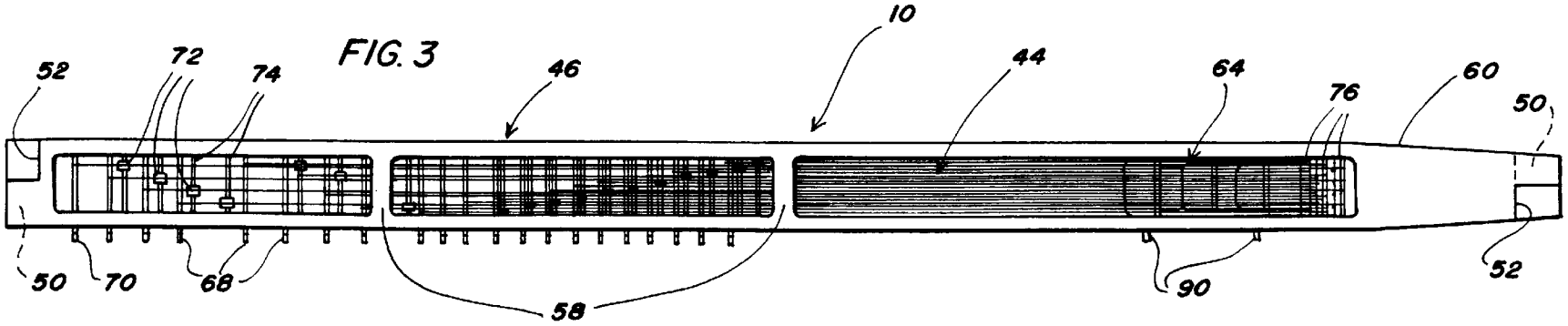
FIG. 3 is a plan view of the device removed from the stringed instrument.
Figure 4:
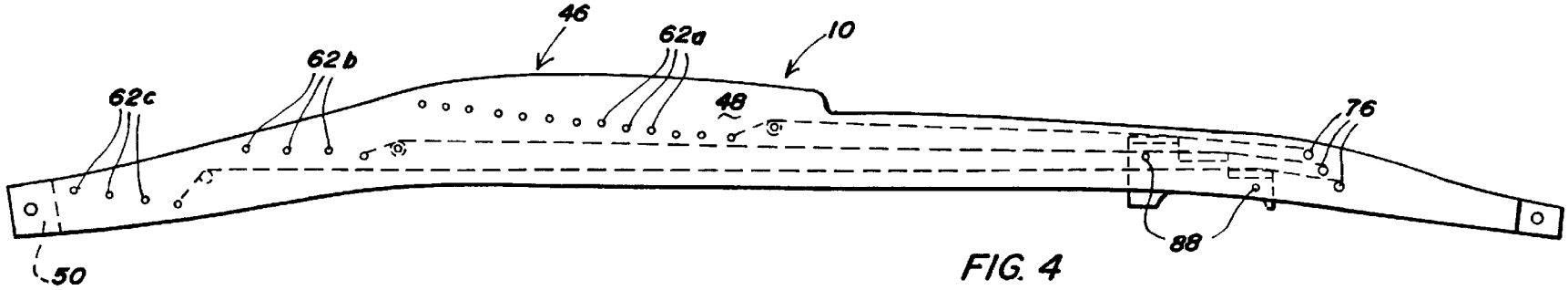
FIG. 4 is a side elevational view of the device removed from the stringed instrument.
Figure 5:
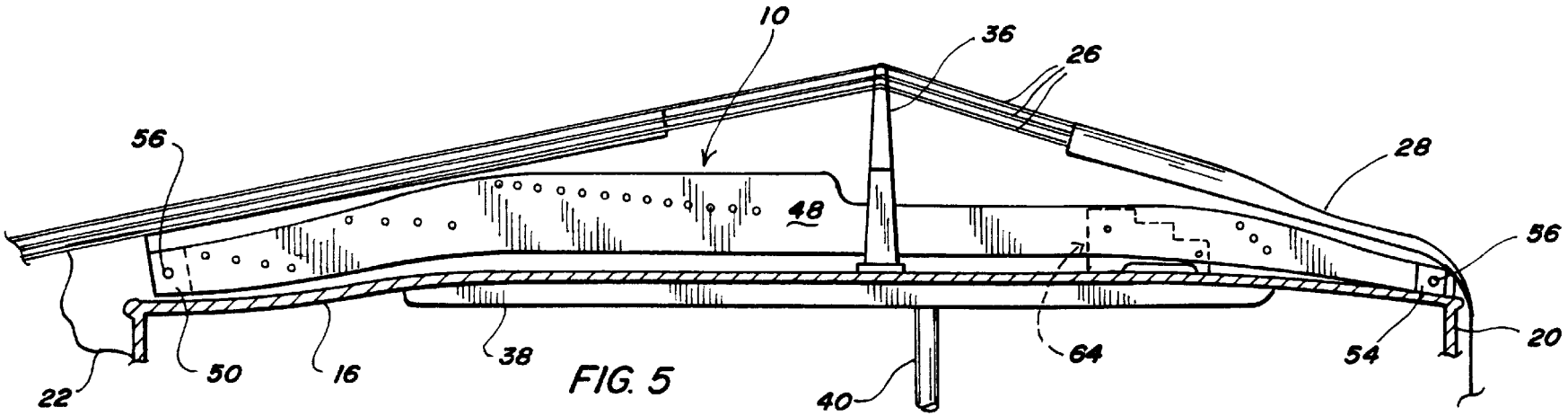
FIG. 5 is a side elevational view, partly in cross-section, of the device shown mounted on the stringed instrument.

Device 10 is adapted for attachment to stringed instrument or bass 12 and has a set of sympathetic strings 44 adapted to be tuned in reference to main strings 26. Sympathetic strings 44 are rigidly mounted under main strings 26 in a frame 46 suspended over sound board 16 in a manner that has substantially no effect on main strings 16 or sound box 14, such as muting the tone of the main strings. In the form illustrated, as shown in FIGS. 3–5, frame 46 is bow shaped to generally conform with the curvature of sound board 16. Frame 46 has two long side rails 48, joined at opposite ends with cross pieces 50. Cross pieces 50 have notches 52 on opposite sides of the frame, for receipt of mounting blocks 54 attached to bass 12 at neck 22 and along rib 20 under tailpiece 28. Opposite ends of frame 46 are detachably mounted to bass 12 with a pin 56 passing though mounting block 54 and cross piece 50. Several transverse braces 58 and an end brace 60 may be provided along the top of frame 46 as reinforcements and for appearance. Frame 46 can be made of maple or other functionally similar materials or, for example, of graphite. These materials being described as examples, however, and not as limitations.

Figure 6:
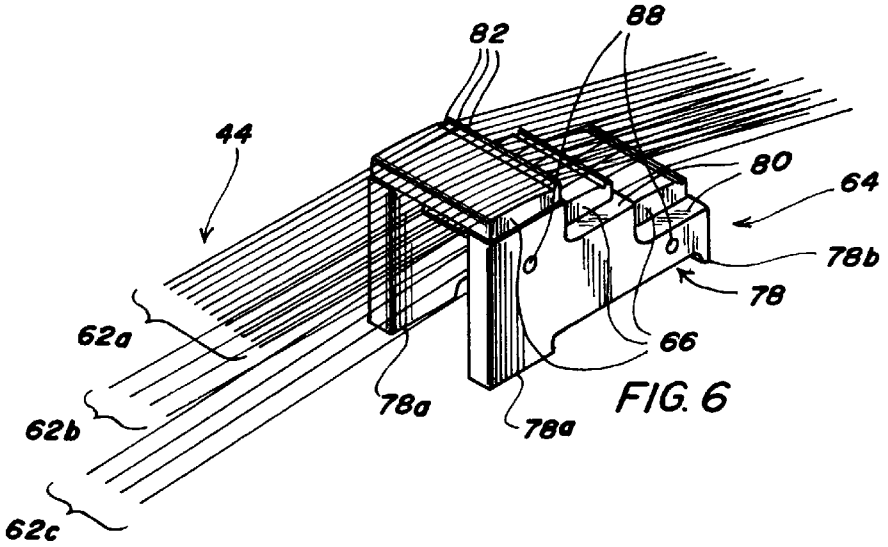
FIG. 6 is a perspective view of the javari bridge with three tiers of sympathetic strings; and, FIG. 7 is a detailed view of a string passing over a javari plate.

A plurality of sympathetic strings, illustrated in three tiers 62*a*, 62*b* and 62*c*, as best seen in FIG. 6, are strung in frame 46 passing over a javari bridge 64 having a javari plate 66 for each tier. Javari bridges are found on eastern instruments such as sitars and have a separate bridge for both main and sympathetic strings, but, insofar as known, javari bridges have not been used on western stringed instruments played with a bow, leastwise for sympathetic strings arranged in tiers on a stepped bridge. In the embodiment shown in the drawings, there are 13 strings in upper tier 62*a* and four strings in middle tier 62*b* and lower tier 62*c*. Sympathetic strings 44 can be formed of steel, phosphor bronze, brass, copper or the like and wrapped or not, according to tuning. The sympathetic strings in each tier are secured at the neck end of frame 46 to tuning pegs 68. Tuning pegs 68 are inserted directly into side rails 48 and have knobs 70 on the right side of frame 46. The sympathetic strings are secured through narrow holes in the stems of the pegs 68 and are wound counter-clockwise as viewed from the knob end. From tuning pegs 68, the sympathetic strings pass over a nut 72, one provided for each string, suspended in frame 46 on a rod 74. On the nuts, the strings are held firmly in little grooves, while the tuning pegs apply downward pressure. From nuts 72, the sympathetic strings pass over javari bridge 64 and then to a string holder 76. String holder 76 is lower than the bridge to apply downward pressure on the strings and, as shown in the drawings, comprises a rod, one provided for each tier, between side rails 48.

Figure 7:
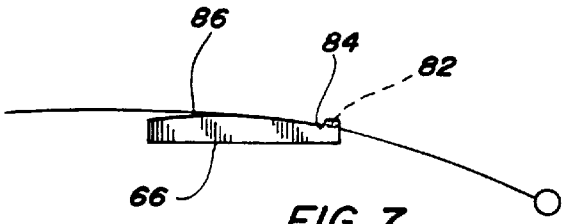

Javari bridge 64 comprises a wooden tripod table 78 with two broad legs 78*a* interconnected by a transverse leg 78*b*. Legs 78*a* and 78*b* are pressed against sound board 16 by the downward pressure of the sympathetic strings. Table 78 can be made of maple, mahogany or other functionally similar materials. When the sympathetic strings are arranged in three tiers, table 78 has three steps, one tread 80 for each tier of sympathetic strings. It will be readily appreciated, however, that javari bridge 64 may have only one tier (with room for fewer sympathetic strings) or more than three (with room for more sympathetic strings), as desired. The number of tiers will be in part dictated by the amount of room under main bridge 36, which is obviously different for a bass than for a violin. When javari bridge 64 is stepped, the vibrations of all the sympathetic strings pass through legs 78*a* and 78*b* for amplification in sound box 14, the effect being different than if the tiers were mounted on separate bridges as in sitars. As best seen in FIGS. 6 and 7, javari bridge 64 is about 5 inches long, 2 inches high and 1.5 inches wide, each step rising about ⅔ inch. Attached to each tread 80 is a javari plate 66, formed of antler, bone or other functionally equivalent material, about 1 inch long, 1.5 inches wide and ¼ inch thick. The sympathetic strings sit in grooves 82 in the back wall of plate 66 behind a lateral furrow 84. The surface of each plate 66 is filed or otherwise shaped in a parabolic contour (FIG. 7) making a contact node 86 with the sympathetic string between a third and halfway back of a forward edge of the plate. It is important that the string fall away from the plate and that there be no dips or bumps. The degree of roll off varies with the thickness and tightness of the strings. With a thicker or looser string, the curvature has to be greater as the string deflects further when it vibrates and will twang against the plate. If the string is too tight, it will not contact the bridge other than at node 86 and will not change the timbre of the instrument as more particularly described below. Javari plates 66 require regular renewal as sympathetic strings 44 cut channels in the bridge radiating longitudinally from nodes 86. Initially the tone improves and then worsens as the node creeps forward and the string begins to node off at more than one point.

Javari bridge 64 is spaced apart from main bridge 36 with one of legs of table 78 proximate base bar 38 and is tucked under tailpiece 28. When it is desired to remove device 10 from bass 12, javari bridge 64 is pinned between side rails 48, two holes 88 being provided therefor in side rails 48 and table 78 for receipt of pins 90. Pins 56 are then removed from mounting blocks 54 releasing frame 46 which can be slid out from under main bridge 36, clearing the mounting blocks at opposite ends, by canting the frame at a slight angle to the midline of the instrument. Device 10 can be stored for reattachment as desired, stringed instrument 12 being playable in an ordinary manner.

In use, device 10 is mounted on bass 12 with sympathetic strings 44 pressing javari bridge 64 against sound board 16. Sympathetic strings 44 are tuned to resonant frequencies that are in harmonic reference to strings 26, expanding the harmonic sounds produced by the instrument. For example, when a low D is played on one of the main strings, the sympathetic strings will resonate the low D, along with sympathetic D's several octaves above and A's and $F^{\#}$'s, though to a lesser degree, octaves above, along with other still weaker resonant frequencies. The addition of more sympathetic strings, for example so that there are 16 on the upper tier and five on the middle and lower tiers would further expand the harmonic sounds produced by the instrument.

Sympathetic strings 44 may be tuned either chromatically or scalularly. If they are tuned chromatically in equal temperament (i.e., 100 cents per half step), some resonance will be lost in the sympathetic strings and device 10 will be a little less functional. Table 1 shows the 66 harmonic divisions of the octave derived from C and is useful for non-tempered, scalular tunings of sympathetic strings 44. While there are even higher overtones, they are beyond the hearing of most persons. In Table 1, the "from" column gives the note name from the initial pitch. The "cents" column shows how many cents the note is from a tempered note of that name, which information is useful to a person using a tempered tuner. The A/B ratio is the mathematical fraction by which the length of the string must be reduced to produce the note. The "decimal" column expresses the A/B ratio as a decimal. The "cents tonic" column shows the note expressed on a scale where there are 1200 cents in an octave, measured from C at 0 cents. The "cents step" shows the difference in cents from the previous note.

As main strings 26 are plucked or bowed, they cause main bridge 36 to vibrate the sound board 16 and bass bar 38. These vibrations stimulate javari bridge 64 setting into vibration any sympathetic strings 44 capable of a sympathetic vibration. The vibrations of the sympathetic strings are transmitted back into sound box 14 where they are amplified. Some of this energy then sets sympathetic bridge 64 into vibration for a second round of sympathetic vibrations and so forth until the energy is dissipated. This happens rather quickly as javari bridge 64 tends to dampen the vibrations as the sympathetic strings beat on javari plates 66. Hence the sound coming from the sympathetic strings tends to rise and fall before the next note is plucked or bowed, avoiding the dissonant medley usually associated with sympathetic strings on bowed instruments. In addition, as sympathetic strings 44 touch the javari bridge in front of nodes 86, the vibrating length of the strings is reduced to a fraction of their original length, causing their frequency to increase, bringing out the upper harmonics. When the upper harmonics are amplified, they are more audible and the sound coming from bass 12 is more brilliant, changing the timbre of the instrument as a result of device 10. The instrument is easily returned to normal by simply removing device 10.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

TABLE 1

| # | from | cents | A/ | B | decimal | cents tonic | cents step | |
|---|---|---|---|---|---|---|---|---|
| 1 | C | 0 | 1 | 1 | 1 | 0 | | 1 |
| 2 | C | 21.506 | 81 | 80 | 1.0125 | 21.506 | 21.5 | 1 |
| 3 | C | 38.051 | 46 | 45 | 1.022222 | 38.051 | 16.5 | 1 |
| 4 | C#/Db | −43.23 | 31 | 30 | 1.033333 | 56.767 | 18.7 | 2 |
| 5 | C#/Db | −29.33 | 25 | 24 | 1.041667 | 70.672 | 13.9 | 2 |
| 6 | C#/Db | −9.775 | 256 | 243 | 1.053498 | 90.225 | 19.6 | 2 |
| 7 | C#/Db | 11.731 | 16 | 15 | 1.066667 | 111.73 | 21.5 | 2 |
| 8 | C#/Db | 33.238 | 27 | 25 | 1.08 | 133.24 | 21.5 | 2 |
| 9 | C#/Db | 47.143 | 135 | 124 | 1.08871 | 147.14 | 13.9 | 2 |
| 10 | D | −35 | 11 | 10 | 1.1 | 165 | 17.9 | 3 |
| 11 | D | −17.6 | 10 | 9 | 1.111111 | 182.4 | 17.4 | 3 |
| 12 | D | 3.91 | 9 | 8 | 1.125 | 203.91 | 21.5 | 3 |
| 13 | D | 23.463 | 256 | 225 | 1.137778 | 223.46 | 19.6 | 3 |
| 14 | D | 47.741 | 15 | 13 | 1.153846 | 247.74 | 24.3 | 3 |
| 15 | D#/Eb | −39.32 | 93 | 80 | 1.1625 | 260.68 | 12.9 | 4 |
| 16 | D#/Eb | −25.42 | 75 | 64 | 1.171875 | 274.58 | 13.9 | 4 |
| 17 | D#/Eb | −5.865 | 32 | 27 | 1.185185 | 294.13 | 19.6 | 4 |
| 18 | D#/Eb | 15.641 | 6 | 5 | 1.2 | 315.64 | 21.5 | 4 |
| 19 | D#/Eb | 29.547 | 75 | 62 | 1.209677 | 329.55 | 13.9 | 4 |
| 20 | D#/Eb | 42.905 | 128 | 105 | 1.219048 | 342.91 | 13.4 | 4 |
| 21 | E | −35.19 | 100 | 81 | 1.234568 | 364.81 | 21.9 | 5 |
| 22 | E | −13.69 | 5 | 4 | 1.25 | 386.31 | 21.5 | 5 |
| 23 | E | 7.82 | 81 | 64 | 1.265625 | 407.82 | 21.5 | 5 |
| 24 | E | 27.373 | 32 | 25 | 1.28 | 427.37 | 19.6 | 5 |
| 25 | E | 43.081 | 31 | 24 | 1.291667 | 443.08 | 15.7 | 5 |
| 26 | F | −43.01 | 125 | 96 | 1.302083 | 456.99 | 13.9 | 6 |
| 27 | F | −23.46 | 320 | 243 | 1.316872 | 476.54 | 19.6 | 6 |
| 28 | F | −1.955 | 4 | 3 | 1.333333 | 498.04 | 21.5 | 6 |
| 29 | F | 19.551 | 27 | 20 | 1.35 | 519.55 | 21.5 | 6 |
| 30 | F | 39.104 | 512 | 375 | 1.365333 | 539.1 | 19.6 | 6 |
| 31 | F#/Gb | −45.19 | 62 | 45 | 1.377778 | 554.81 | 15.7 | 7 |
| 32 | F#/Gb | −31.28 | 25 | 18 | 1.388889 | 568.72 | 13.9 | 7 |
| 33 | F#/Gb | −9.776 | 45 | 32 | 1.40625 | 590.22 | 21.5 | 7 |
| 34 | F#/Gb | 9.7763 | 64 | 45 | 1.422222 | 609.78 | 19.6 | 7 |

TABLE 1-continued

| # | from | cents | A/ | B | decimal | cents tonic | cents step | |
|---|---|---|---|---|---|---|---|---|
| 35 | F#/Gb | 31.283 | 36 | 25 | 1.44 | 631.28 | 21.5 | 7 |
| 36 | F#/Gb | 45.188 | 90 | 62 | 1.451613 | 645.19 | 13.9 | 7 |
| 37 | G | −39.1 | 375 | 256 | 1.464844 | 660.9 | 15.7 | 8 |
| 38 | G | −19.55 | 40 | 27 | 1.481481 | 680.45 | 19.6 | 8 |
| 39 | G | 1.955 | 3 | 2 | 1.5 | 701.96 | 21.5 | 8 |
| 40 | G | 23.461 | 243 | 160 | 1.51875 | 723.46 | 21.5 | 8 |
| 41 | G | 43.014 | 192 | 125 | 1.536 | 743.01 | 19.6 | 8 |
| 42 | G#/Ab | −41.28 | 31 | 20 | 1.55 | 758.72 | 15.7 | 9 |
| 43 | G#/Ab | −27.37 | 25 | 16 | 1.5625 | 772.63 | 13.9 | 9 |
| 44 | G#/Ab | −7.82 | 128 | 81 | 1.580247 | 792.18 | 19.6 | 9 |
| 45 | G#/Ab | 13.686 | 8 | 5 | 1.6 | 813.69 | 21.5 | 9 |
| 46 | G#/Ab | 27.592 | 50 | 31 | 1.612903 | 827.59 | 13.9 | 9 |
| 47 | G#/Ab | 35.193 | 81 | 50 | 1.62 | 835.19 | 7.6 | 9 |
| 48 | A | −37.15 | 400 | 243 | 1.646091 | 862.85 | 27.7 | 10 |
| 49 | A | −15.64 | 5 | 3 | 1.666667 | 884.36 | 21.5 | 10 |
| 50 | A | 5.865 | 27 | 16 | 1.6875 | 905.87 | 21.5 | 10 |
| 51 | A | 25.418 | 128 | 75 | 1.706667 | 925.42 | 19.6 | 10 |
| 52 | A | 41.126 | 31 | 18 | 1.722222 | 941.13 | 15.7 | 10 |
| 53 | A#/Bb | −44.97 | 125 | 72 | 1.736111 | 955.03 | 13.9 | 11 |
| 54 | A#/Bb | −23.46 | 225 | 128 | 1.757813 | 976.54 | 21.5 | 11 |
| 55 | A#/Bb | −3.91 | 16 | 9 | 1.777778 | 996.09 | 19.6 | 11 |
| 56 | A#/Bb | 17.596 | 9 | 5 | 1.8 | 1017.6 | 21.5 | 11 |
| 57 | A#/Bb | 29.577 | 29 | 16 | 1.8125 | 1029.6 | 12 | 11 |
| 58 | A#/Bb | 49.363 | 11 | 6 | 1.833333 | 1049.4 | 19.8 | 11 |
| 59 | B | −33.24 | 50 | 27 | 1.851852 | 1066.8 | 17.4 | 12 |
| 60 | B | −11.73 | 15 | 8 | 1.875 | 1088.3 | 21.5 | 12 |
| 61 | B | 9.775 | 243 | 128 | 1.898438 | 1109.8 | 21.5 | 12 |
| 62 | B | 29.328 | 48 | 25 | 1.92 | 1129.3 | 19.6 | 12 |
| 63 | B | 45.036 | 31 | 16 | 1.9375 | 1145 | 15.7 | 12 |
| 64 | C | −41.06 | 125 | 64 | 1.953125 | 1158.9 | 13.9 | 13 |
| 65 | C | −21.51 | 160 | 81 | 1.975309 | 1178.5 | 19.6 | 13 |
| 66 | C | 0 | 2 | 1 | 2 | 1200 | 21.5 | 13 |

What is claimed:

1. A device for selectively changing the timbre of a stringed instrument including a main bridge, a sound board and a set of main strings that are played with a bow, said device comprising a plurality of sympathetic strings tunable to resonant frequencies in reference to the main strings, said sympathetic strings rigidly mounted under the main strings in an elongated frame passing through the main bridge and suspended over the sound board, a javari bridge within the elongated frame, mounted on the sound board and spaced apart from the main bridge, said sympathetic strings passing over the javari bridge whereby vibrations on the main strings are transferred to any of the sympathetic strings capable of sympathetic vibration, said javari bridge bringing out upper harmonic vibrations in the sympathetic strings, making the sympathetic vibrations more audible and shortening the period of vibration.

2. The device of claim 1 wherein the frame is bow shaped and has opposite ends, said frame conformed to the curvature of the sound board and to be detachably suspended over the sound board.

3. The device of claim 1 wherein the javari bridge is a tripod table with two broad legs interconnected by a transverse leg and has more than one step, each step having a tread upon which a javari plate is seated, said javari plate having a parabolic contour making a contact node with the sympathetic strings between about a third and halfway back of a forward edge of the plate.

4. The device of claim of claim 3 wherein the javari bridge has three steps and the sympathetic strings are arranged in three tiers.

5. A device for selectively changing timbre of a stringed instrument including a main bridge having one foot proximate a base bar and another foot adjacent a sound post, a sound board and a set of main strings that are played with a bow, said device including a plurality of sympathetic strings tunable to resonant frequencies in harmonic reference to the main strings, said sympathetic strings rigidly mounted under the main strings in an elongated frame passing under the main bridge, said frame suspended over the sound board, a javari bridge within the elongated frame, mounted on the sound board, proximate the base bar and spaced apart from the main bridge, said sympathetic strings passing over the javari bridge whereby vibrations on the main strings are transferred to any of the sympathetic strings capable of sympathetic vibration, said javari bridge bringing out upper harmonic vibrations, making the sympathetic vibrations more audible and shortening the period of vibration.

6. The device of claim 5 wherein the frame comprises a pair of rails that are joined at opposite ends with a cross piece, said sympathetic strings having first and second ends, said strings attached at the first end to the rails with tuning pegs attached to the rails, said strings attached at the second end to the rails with a string holder attached to the rails, said string holder being lower than the javari bridge such that the string holder applies downward pressure on the sympathetic strings.

7. The device of claim 6 wherein from the tuning pegs, the sympathetic strings pass over nuts attached to the side rails, said tuning pegs applying downward pressure on the sympathetic strings.

8. The device of claim 7 wherein the javari bridge is a tripod table with two broad legs interconnected with a transverse leg and has more than one step, each step having a tread upon which a javari plate is seated, said javari plate having a parabolic contour making a contact node with the sympathetic strings between about a third and halfway back of a forward edge of the plate.

9. The device of claim of claim 8 wherein the javari bridge has three steps and the sympathetic strings are arranged in three tiers.

10. A javari bridge comprising a tripod table with two broad legs interconnected by a transverse leg and having more than one step, each step having a tread upon which a javari plate is seated, each javari plate having a parabolic contour making a contact node with one or more strings exerting a downward pressure on the plate, said contact node being between about a third and halfway back of a forward edge of the plate.

11. The javari bridge of claim 10 wherein the tripod table has three steps whereby the strings are arranged in three tiers.

* * * * *